United States Patent [19]

Ray

[11] Patent Number: 4,813,437

[45] Date of Patent: Mar. 21, 1989

[54] NICOTINE DISPENSING DEVICE AND METHOD FOR THE MANUFACTURE THEREOF

[76] Inventor: J. Philip Ray, 2929 Mossrock, Ste. 130, San Antonio, Tex. 78230

[21] Appl. No.: 569,279

[22] Filed: Jan. 9, 1984

[51] Int. Cl.[4] ..... A24D 1/00; A24F 1/00

[52] U.S. Cl. ..... 131/273; 131/270; 131/335; 128/202.21

[58] Field of Search ..... 131/273, 335, 365, 337; 128/202.21

[56] References Cited

U.S. PATENT DOCUMENTS

| | | | |
|---|---|---|---|
| 2,445,476 | 7/1948 | Folkman | 131/273 |
| 3,422,819 | 1/1969 | Jones et al. | 131/335 |
| 4,284,089 | 3/1980 | Ray | 131/273 |
| 4,480,644 | 11/1984 | Luke | 131/365 |

FOREIGN PATENT DOCUMENTS

| | | | |
|---|---|---|---|
| 1270933 | 7/1961 | France | 131/337 |

OTHER PUBLICATIONS

Wynder and Hoffman, Tobacco and Tobacco Smoke, Studies in Experimental Carcinogenesis, pp. 496-501 (1967).

*Primary Examiner*—V. Millin

*Attorney, Agent, or Firm*—Arnold, White & Durkee

[57] ABSTRACT

An improved nicotine dispensing device for non-pyrolytic use which is adapted to release nicotine-bearing vapors into air drawn through the device. The device comprises one or more nicotine-bearing sections, one or more insulating sections which are linearly aligned with nicotine-bearing sections and a fluid impermeable housing. The housing retains the nicotine-bearing and insulating sections. This invention also includes a method for the preparation of an improved nicotine dispensing device. The method includes the steps of preparing one or more fluid retaining sections and one or more insulating sections. The fluid retaining sections and insulating sections are linearly arranged and wrapped with a fluid impermeable housing material. A nicotine containing material is then injected into, or incorporated within, the fluid retaining sections.

7 Claims, 2 Drawing Sheets

Fig. 1
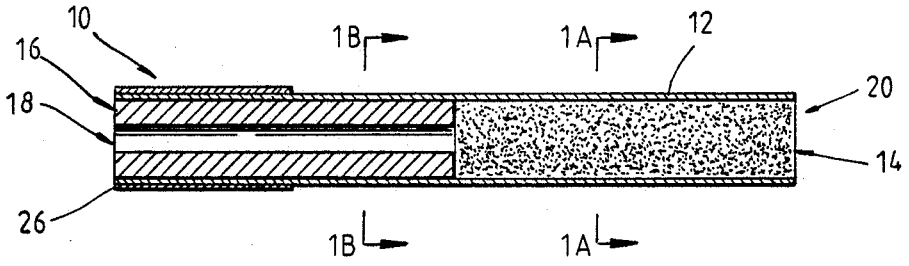
Fig. 1A
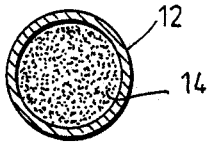
Fig. 1B
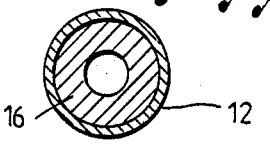
Fig. 2
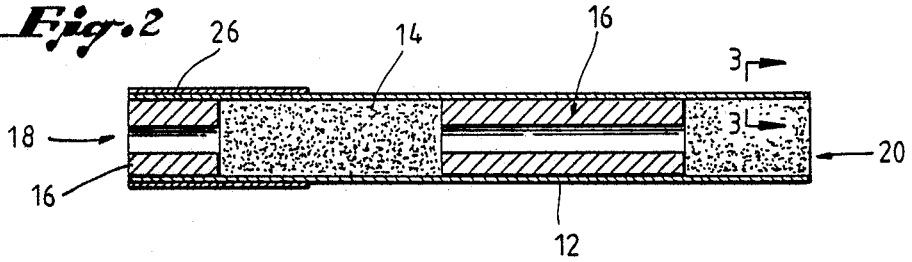
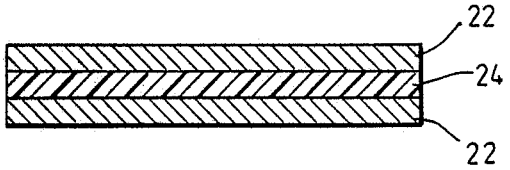
Fig. 3

NICOTINE DISPENSING DEVICE AND METHOD FOR THE MANUFACTURE THEREOF

BACKGROUND OF THE INVENTION

This invention relates to improved nicotine dispensing devices designed to reduce or eliminate the disadvantages associated with conventional smoking habits using combustible cigarettes. In the preferred embodiment of the nicotine dispensing device of this invention the device is configured in the shape and size of a conventional combustible cigarette. However, this feature is for aesthetics only and is not related to function. This invention further relates to a method for the production of the improved nicotine dispensing devices of this invention. The device of this invention represents an improvement over the simulated smoking device described and claimed in commonly assigned U.S. Pat. No. 4,284,089 which is incorporated herein by reference.

The use of nicotine has long been practiced by persons in many cultures, who derive satisfaction from the substance. Nicotine is a liquid alkaloid having the formula $C_5H_4NC_4H_7NCH_3$ and which is toxic in humans above certain levels. When nicotine is obtained from tobacco, as by chewing, sniffing, or smoking the substance, the amount of nicotine absorbed into the body generally does not build up to a harmful dose, but produces a certain pleasurable effect, frequently leading to habitual use.

One of the most popular versions of nicotine use involves the smoking of cigarettes. When the tobacco in a conventional cigarette is ignited, the combustion of the processed tobacco within the cigarette causes the release of vaporous nicotine, which is drawn through the cigarette and into the user's mouth and lungs when the user sucks or inhales air through the cigarette.

The relative mildness of a cigarette, as compared to a pipe or cigar, permits a user to draw the smoke from the burning cigarette directly into the lungs. The nicotine vapors in the cigarette smoke are rapidly assimilated into the bloodstream of the user from the lungs, so that cigarette smoking provides a method by which a user may very quickly feel the effects of the nicotine. Preferably to the cigarette user, nicotine is absorbed by the lungs and therefore reaches physiologically significant levels in the bloodstream leading to the brain much more rapidly than if absorbed in the mouth (bucal mucosa) or other tissue.

Although nicotine can be readily introduced into the body through cigarette smoking, the combustion of tobacco, with the consequent elevated temperatures required in this process, unfortunately result in a number of undesirable consequences. Of primary concern are the serious health hazards known to result from smoking combustible cigarettes. Although the nicotine content of a cigarette is not believed to cause any serious adverse long term health effects on the human body, other components which are harmful are present in tobacco smoke. Some of these other constituents are known carcinogens. A table listing some of the harmful components in tobacco smoke may be found on pp. 496–501 of the publication *Tobacco and Tobacco Smoke, Studies in Experimental Carcinogenesis,* (1967) by Ernest L. Wynder and Dietrich Hoffman of the Sloan-Kettering Institute for Cancer Research. The teaching of that publication is hereby incorporated by reference into this application.

Furthermore, the smoking of combustible cigarettes may pose a significant fire hazard. Many fires which have occurred both within buildings and in natural environments have been attributable to burning cigarettes which were carelessly discarded. In addition, substantial economic loss can be attributed to smoking, including significant damage to business and personal property resulting from burns in clothing, carpeting, furniture, etc. caused by stray ashes from cigarettes. Cigarette smoking has also become increasingly objectionable because of the discomfort it may cause to nonsmokers who are exposed to the smoke and odor produced by the smoking habit.

Because of these undesirable side effects of combustible cigarette smoking, attempts have been made from time to time to provide an acceptable substitute for combustible cigarette smoking which will eliminate or ameliorate the adverse consequences mentioned above. Tobacco concentrates, for example, have been processed into a tablet which may be sucked or chewed in the mouth of the user, the nicotine being absorbed into the user's body through the lining of the mouth. Such a tablet, does not provide the user with the feel of a cigarette between his or her lips. Furthermore, a tablet smoking substitute cannot provide the user with an opportunity to draw air and vapors into the mouth nor inhale that air and vapors into the lungs, which is an essential part of the conventional smoking habit. These activities constitute an important aspect of the psychological and physiological affinity which a smoker acquires for the nicotine habit. Without an effective substitute for such smoking activities, a tablet form of tobacco is likely not to satisfy the smoker and may thus result in a return to combustible cigarette smoking.

In another approach to providing a substitute for smoking, it has been recognized that processed tobacco, such as that contained in cigarettes, will release vapors even when it is heated to a temperature lower than the ignition point of the tobacco. Thus, a smoker might draw air through such heated tobacco and thereby obtain the vapors which are released in conventional smoking without also inhaling the noxious by-products of tobacco combustion. Devices manufactured according to the technique have sometimes used a second isolated portion of tobacco, which is ignited, as the source of heat. Although such a device is chambered so that the products of combustion are not directly inhaled by the user in the act of drawing air through such a device, the harmful by-products of combustion are nevertheless released into the air surrounding the user. Thus substantial amounts of the deleterious combustion by-products may nevertheless be inhaled by the user and surrounding persons through breathing the ambient air.

In addition, with such a substitute device, substantially the same fire hazards are presented as with conventional smoking devices, and there remains the potential for burn damage to carpets, furniture, clothing, etc. Alternatively, the tobacco in this method may be heated by various pyrophorous materials, which are mixed together with the tobacco. Such materials react with oxygen, alcohol, water, etc. and thereby produce sufficient heat to cause the tobacco to release vapors. With this technique, however, any by-products of the combustion reaction, which occurs within the tobacco mix, will also tend to be inhaled through the device by the user. Thus, there is the danger of adverse health consequences resulting whenever any of these by-products are toxic or otherwise harmful. Furthermore, the structure of such devices tend to be unduly complex, resulting in a relatively high manufacturing cost.

Various other smoking substitutes have been developed which include cigarette simulating devices containing various materials which approximate the taste and aroma of tobacco or release various other additional aromatic vapors which are intended to have a satisfying effect on the user when those vapors are inhaled. In one such device, synthetic materials simulating the taste and aroma of tobacco are micro-encapsulated within a cigarette substitute device. The desired vapors are released by squeezing or crushing the device, causing the capsules to burst and the vapors to be released into the air drawn through the device. In another such device, the flavor and taste components of tobacco are saturated within a capsule containing an absorbent material, and, when punctured, the capsule releases the aroma and flavor volatiles of tobacco into the air drawn through the device. These devices, however, have failed to take into account that the primary physiological phenomenon related to cigarette smoking, which must be provided in any effective substitute, is the sudden introduction of nicotine vapor into the user's lungs to satisfy the user's habit.

Thus, despite the various attempts which have been made to provide effective substitutes for combustible cigarettes, no one has developed a device which permits the user to inhale controlled amounts of nicotine vapor, free of all known or suspected carcinogens, sufficient to satisfy a nicotine habit without the need for combustion or other heating means and without the need for the user taking some unfamiliar action other than the actions performed in the conventional smoking habit, namely drawing or sucking a gaseous mixture through a cigarette and inhaling that gaseous mixture into the lungs of the user.

Therefore, a need has developed for a substitute for combustible cigarettes which will release nicotine vapor into the air drawn through the substitute device by a smoker without the need for any heating means or any action on the user's part other than drawing air through the cigarette as is done with a conventional cigarette.

To an extent the need defined above has been satisfied by a device described as a simulated smoking device and which is the subject of U.S. Pat. No. 4,284,069. The device of U.S. Pat. No. 4,284,069 suffers from serious deficiencies when actually produced and used in large quantities. In particular, the device, as described in the preferred embodiment, required an excessive amount of nicotine mixture in the nicotine containing member when the draw and delivery characteristics were adjusted to simulate those of a conventional cigarette. Also, the construction of the device, as described in the preferred embodiment, did not allow the use of currently available large scale manufacturing techniques and equipment.

Both of these deficiencies restricted the manufacturing of the device within competitive cost requirement, as related to the production costs of conventional cigarettes.

The improved device of this invention satisfies both of these disadvantages associated with the prior art device.

SUMMARY OF THE INVENTION

This invention provides a nicotine dispensing device which is adapted for non-burning or non-combustion uses. For purposes of convenience this shall be referred to as non-pyrolytic use. This device, hence, provides the user with the nicotine desired from, for example, a conventional cigarette without the need for either burning, combustion or having to somehow elevate the temperature of the tobacco to cause the vaporization of nicotine.

An improved nicotine dispensing device is provided for non-pyrolytic use. The device is adapted to release nicotine bearing vapors into the air drawn through the device. The device comprises one or more nicotine bearing sections in combination with one or more insulating sections which are linearly aligned with the nicotine bearing sections. The nicotine bearing and insulating sections are contained by a fluid impermeable housing.

A method is also provided for the preparation of an improved nicotine dispensing device. Again, the improved device is for non-pyrolytic use and is adapted to release nicotine bearing vapors into air drawn through the device. The method comprises the steps of preparing one or more fluid retaining sections and one or more insulating sections. The fluid retaining sections and insulating sections are linearly arranged and then wrapped with a fluid impermeable housing material. The fluid retaining sections include a nicotine containing material.

The nicotine mixture within the nicotine containing material may be selected from the group consisting of nicotine (d), nicotine (1), nicotine (d1) and nicotine salts. The nicotine mixture may further include other ingredients for flavoring and pH adjustment of the mixture, and water to adjust the humidity of the vapors released.

In a preferred embodiment, the housing is tubular in shape, with an outer diameter, a length, and a weight, selected to simulate the appearance of a conventional cigarette. The cigarette may further include a cylindrical band affixed around one end of the housing, the band being adapted to simulate the appearance of a filtertip.

Examples of the more important features of this invention have thus been broadly outlined in order that the detailed description which follows may be better understood, and so that the contributions which this invention provides to the art may be better appreciated. There are, of course, additional features of the invention which will be described herein and which will be included within the subject matter of the claims appended hereto.

BRIEF DESCRIPTION OF THE DRAWINGS

Additional objects, features, and advantages of the present invention will become apparent by referring to the following detailed description of the preferred embodiments, in connection with the accompanying drawings, wherein like reference numerals refer to like elements throughout all the figures.

In the drawings:

FIG. 1 is a side elevation in longitudinal section which illustrates one embodiment of an improved nicotine dispensing device constructed in accordance with the present invention.

FIG. 1A is a cross section of the device of FIG. 1 taken at line 1A—1A of FIG. 1.

FIG. 1B is a cross section of the device of FIG. 1 taken at line 1B—1B of FIG. 1.

FIG. 2 is side elevation in longitudinal section illustrating a second and preferred embodiment of the improved nicotine dispensing device constructed in accordance with the present invention.

FIG. 3 is a cross section of the housing material of FIG. 2 taken at line 3—3 of FIG. 2.

DESCRIPTION OF THE PREFERRED EMBODIMENTS

Figure 4:
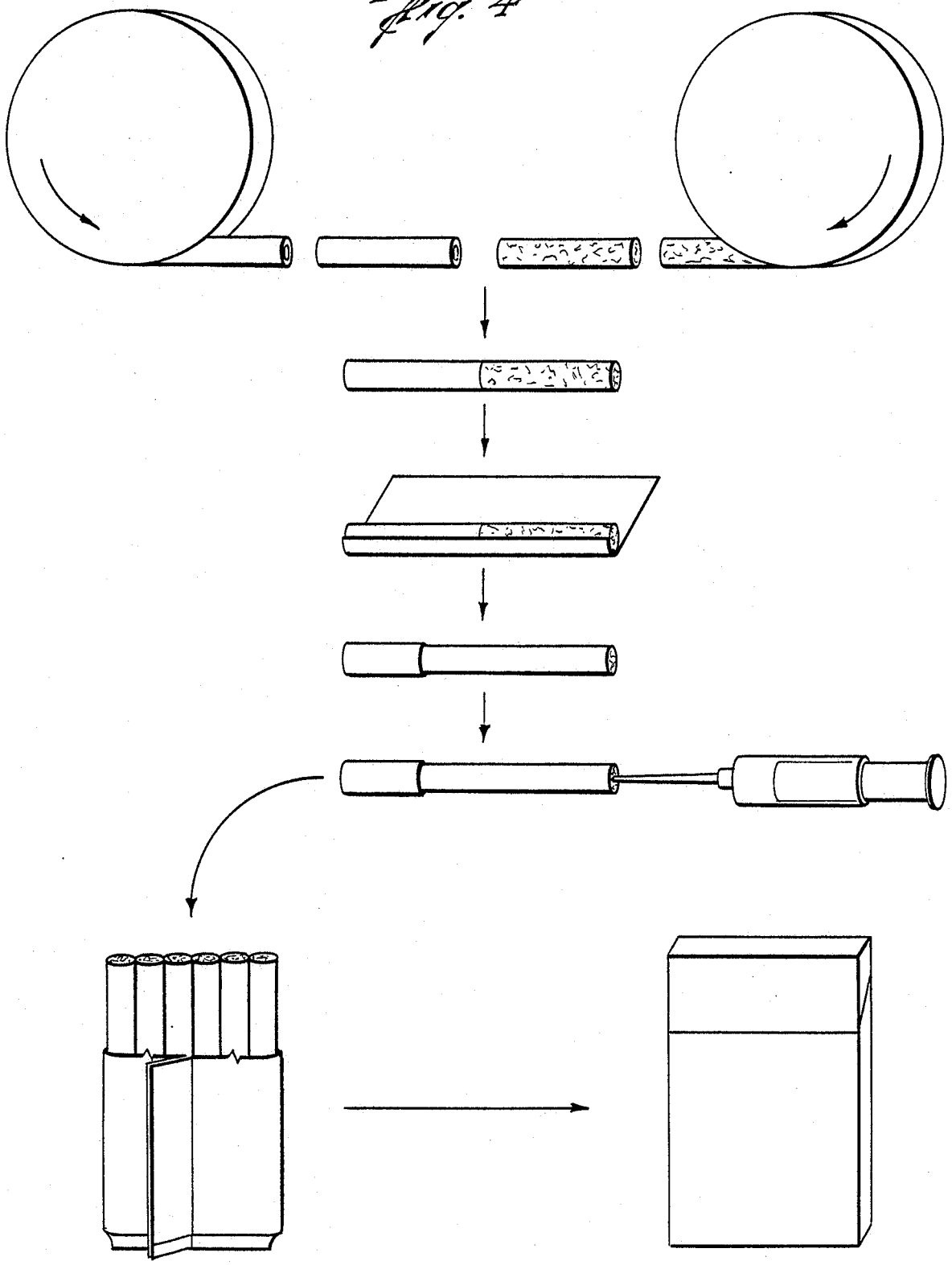
FIG. 4 schematically illustrates the method of preparation of the present invention.

Now referring to the drawings, and first to FIGS. 1, 1A and 1B, one embodiment of the present invention is illustrated in a side elevation. The non-combustible cigarette 10 includes a nicotine bearing section 14, an insulating section 16 and a housing 12. The nicotine bearing section 14 is sometimes referred to as the fluid retaining section prior to inclusion or injection of nicotine material. For ease of illustration, FIG. 1 represents a single nicotine bearing section and a single insulating section. However, it should be understood that a plurality of sections, such as illustrated in FIG. 2, can be conveniently, and in fact preferably, used in the manufacture of the dispensing device of this invention.

When a user places the mouth end 18 of the dispensing device 10 between his or her lips and inhales through the device, as with a conventional cigarette, air is drawn into the intake end 20 of the device. The air drawn through the device mixes with vapors from the nicotine mixture and then passes into the user's mouth, throat and lungs where the nicotine vapors are absorbed into the user's body.

Now referring to the structure of the device 10 in more detail, the housing 12 is constructed of a flexible material which can be wrapped around nicotine bearing sections 14 and insulating sections 16. In other embodiments, the housing 12 may be a molded plastic and the various sections may be inserted into one or both of the central apertures at the ends of such a molded tube. The housing may come in a variety of sizes and shapes. All of these are dependent upon the end use and desired end product.

In the preferred embodiment of this invention, such as illustrated in FIG. 1, the housing 12 is constructed of a laminer flexible material having one or two papers layers 22 and a single polymer layer 24. The paper layers 22 are fibrous materials such as conventional cigarette paper. The polymer layer 24 is typical polymer material and is most preferably cellulose acetate, polypropylene, polyester or combinations thereof. In other embodiments of this invention other laminer sequences may be used. It is not necessary to have a paper layer although it has been found convenient to have the paper later adjacent the outside surfaces of the nicotine bearing sections and insulating sections so that appropriate adherence by use of standard adhesives can be maintained.

In addition, a band 26, made of paper, cork, or another suitable material, may be applied around the mouth end 18 of the device to simulate the appearance of the filter tip on a conventional cigarette. By thus making the device 10 similar in appearance to a conventional cigarette, the appeal of this device as a substitute for a combustible cigarette will be enhanced, since the user may thus psychologically tend to feel as if he or she is handling and using a familiar smoking product.

Referring now more particularly to FIGS. 1, 1A, 1B and 2, the nicotine bearing sections are shown. In particular, the nicotine bearing sections 14 include a fibrous material which is configured to retain a nicotine mixture. Specifically, it has been shown that polyester tow, cellulose acetate, polypropylene and combinations thereof are effective fibrous materials for use in the manufacture of the nicotine bearing section 14. In such a configuration the individual fibers of fibrous material 14 retain the nicotine mixture.

Thus, it can be seen that in its simplest form, nicotine bearing section 14 includes a fibrous material internal to the housing 12. The nicotine containing fluid may be retained by a simple capture of the droplets by the fibrous material or in certain embodiments, the mixture may be contained within the fibers themselves. Any configuration or type of fibrous material is acceptable for purposes of this invention so long as the material is chemically inert to the nicotine formula.

In the most preferred embodiment of this invention, the nicotine bearing sections and the insulating sections are configured to simulate the pressure drop associated with a conventional cigarette.

The insulating sections 16 are designed to enable the manufacturer to simulate the feel and appearance of a conventional filter tip cigarette. In particular, it should be noted that insulating section 16 contains an outer layer 26 which is immediately adjacent and typically attached to housing 12. The materials from which insulating section 16 can be manufactured are well known in the tobacco related arts. In this particular instance, it is preferred that the materials are chemically inert to nicotine and wherein said insulating sections are formed from polypropylene, polyester, cellulose acetate, polypropylene or combinations thereof.

During manufacture, the nicotine bearing sections 14 and insulating sections 16 are linearly aligned. In the most preferred embodiment of this invention involving more than two sections the nicotine bearing sections and insulating sections in addition to being linearly aligned are arranged to be sequentially alternating. This sequence is demonstrated by FIG. 3.

The nicotine bearing sections 14 typically contain from 1 to 30 milligrams of nicotine depending on the overall configuration of the device and the intended end use. It has been found that a number of substances may be advantageously provided in the nicotine mixture which is placed in nicotine bearing sections 14. Nicotine (d), nicotine (l), nicotine (dl) and nicotine salts may all be used to advantage in this device to provide the nicotine vapors which are inhaled by the user. Ninety-eight percent nicotine (l), a product obtained from Eastman Chemical Company, Stock No. 1242, has been used in one embodiment of the device and found to perform with satisfactory results.

It has been found that a number of variables in the construction of the dispensing device effect the quantity of nicotine which will be vaporized into a given volume of air drawn through the device. Among these factors are the viscosity of the nicotine solution: the vapor pressure of the nicotine mixture, and the velocity and the amount of air drawn through the device itself. All of these variables may be adjusted through experimentation to obtain a suitable ratio of the nicotine mixture vapors to the air inhaled by the user.

It has been found that when the device 10 is in a static condition, i.e. no air is being drawn through the device, the vapor pressure of a typical nicotine mixture is such that very little evaporation of the mixture occurs.

The housing 12, nicotine bearing sections 14 and insulating sections 16 are arranged to permit a free flow of air through the nicotine bearing sections 14. The configuration of the device is designed to simulate the pressure drop normally associated with conventional cigarettes. This provides a pleasing effect to the user of the device. In order to simulate this, it is necessary that the flow of air through the insulating sections 16 be primarily unobstructed whereas there is some pressure drop associated with passage of the air through the nicotine bearing sections 14.

In the process of this invention, the fluid retaining section supply is metered into the insulating section supply with the necessary cutting and combining operations. The apparatus for performing such cutting and combining are standard within the tobacco industry. However, a Molins dual rod combiner is exemplary of the type of combiner apparatus which may conveniently be used in the process of this invention. The insulating sections and fluid retaining sections are combined and arranged in accordance with the prior teaching of this application.

The combined and arranged sections, preferably linearly arranged and most preferably in a sequentially alternating fashion, are then wrapped in the housing material as described hereinbefore.

Optionally, after the fluid retaining and insulating sections have been wrapped, the product is tipped by the use of conventional cigarette tipping paper or the like. A Hauni Max-3 tipper is a conventional piece of tipping apparatus which can be used in the process of this invention. Following any such tipping and combining operations, the nicotine mixture is injected or otherwise disposed into the fluid retaining section to convert the fluid retaining section into a nicotine bearing section. This may be accomplished by any of a variety of well known commercial procedures. The preferred apparatus is the HMC needle load injector.

Alternatively, the nicotine bearing section may include a nicotine mixture which has been added to the fibers during the fiber manufacturing process.

Subsequent to loading with the nicotine mixture, the devices are finished by a variety of steps including any of a number of arrangements of counting, cutting, sealing, and/or packaging. For convenience, a Molins hinged lid packer can be used if the units are to be inserted into a standard cigarette type package. FIG. 4 schematically illustrates the method of preparation of the present invention.

Although a typical embodiment of the present invention has been illustrated and discussed herein, numerous modifications and alternative embodiments of the apparatus and method of the apparatus, device and method of this invention will be apparent to those skilled in the art in view of this description. Accordingly, this description is to be construed as illustrative only and is provided for the purpose of teaching those skilled in the art the manner of constructing the device and performing the method of the invention. It is to be understood that the forms of the invention shown and described herein are to be considered as the presently preferred embodiments. Various changes may be made in the configurations, sizes and arrangements of the parts of the invention, as will be recognized by those skilled in the art, without departing from the scope of the invention. For example, equivalent elements might be substituted for those illustrated and described herein, parts or connections might be reversed or otherwise interchanged, and certain features of the invention might be utilized independently of the other features, all as will be apparent to one skilled in the art after receiving the benefit attained through reading the foregoing description of the invention.

What is claimed is:

1. An improved nicotine dispensing device for non-pyrolytic use, said device being adapted to release nicotine-bearing vapors into air drawn through said device, said device comprising:

(a) one or more nicotine-bearing sections containing from 1 to 30 mg. of nicotine, characterized by the presence of a fibrous material, said fibrous material being selected from the group consisting of: polyester tow, cellulose acetate, polypropylene and combination thereof;

(b) one or more insulating sections made from a material which is chemically inert to nicotine and wherein said insulating sections are linearly aligned with said nicotine-bearing sections and are arranged to be sequentially alternating with said nicotine bearing sections; and (c) a fluid impermeable housing, said housing retaining said nicotine bearing and insulating sections, and housing being formed from a laminar flexible material, said material including at least one paper layer and at least one polymer layer.

2. The improved nicotine dispensing device of claim 1 wherein said fibrous material is configured to permit the free flow of air drawn through said dispensing device.

3. The improved nicotine dispensing device of claim 1 wherein the configuration of said insulating sections and said nicotine bearing sections are designed to simulate the pressure drop associated with conventional cigarettes.

4. The improved nicotine dispensing device of claim 1 wherein the material forming said polymer layer is selected from the group consisting of: cellulose acetate, polypropylene, polyester, polyethylene and combinations thereof.

5. The improved nicotine dispensing device of claim 1 wherein said laminar, flexible material includes two paper layers separated by a polyester layer, said paper layers permitting the attachment of said flexible material to the outermost surface of said nicotine bearing sections and said insulating sections.

6. The improved nicotine dispensing device of claim 1 wherein said housing is adapted to simulate the appearance of a filter-tip cigarette.

7. An improved nicotine dispensing device for non-pyrolytic use, said device being adapted to release nicotine bearing vapors into air drawn through said device, said device comprising:

(a) one or more nicotine bearing sections containing from 1 to 30 milligrams of nicotine, characterized by the presence of a fibrous material, said fibrous material being selected from the group consisting of: polyester tow, cellulose acetate, polypropylene and combinations thereof; said fibrous material being configured to permit the free flow of air drawn through said dispensing device;

(b) one or more insulating sections made from a material which is chemically inert to nicotine and wherein said insulating sections are linearly aligned with said nicotine bearing sections and are arranged to be sequentially alternating with said nicotine-bearing sections; and (c) a fluid impermeable housing, said housing retaining said nicotine bearing and insulating sections, said housing being formed from a laminar flexible material that includes two paper layers separated by a polyester layer, said paper layers permitting the attachment of said flexible material to the outermost surface of said nicotine bearing sections and said insulating sections.

* * * * *